United States Patent [19]

Adinamis

[11] 4,428,988

[45] Jan. 31, 1984

[54] ILLUMINATED ORNAMENTAL STRUCTURE OF INTERPOSED TRANSMISSIVE SLATS AND COLLARS

[76] Inventor: Peter J. Adinamis, 7035 N. Tripp Ave., Lincolnwood, Ill. 60646

[21] Appl. No.: 269,399

[22] Filed: Jun. 1, 1981

[51] Int. Cl.[3] ..... F21V 7/04

[52] U.S. Cl. ..... 428/8; 428/20; 206/577; 362/32; 362/123; 362/252; 362/806; 362/223

[58] Field of Search ..... 362/32, 123, 252, 806, 362/223; D11/118; 428/8, 18, 20; 206/577

[56] References Cited

U.S. PATENT DOCUMENTS

| | | | |
|---|---|---|---|
| Re. 25,895 | 11/1965 | Paige | 362/806 X |
| D. 130,937 | 12/1941 | Dennison | D11/118 |
| D. 224,610 | 8/1972 | Dustman | D11/118 |
| D. 250,519 | 12/1978 | Hashimoto | D11/118 |
| D. 258,898 | 4/1981 | Grandish | D11/118 X |
| 2,041,481 | 5/1936 | Otar . | |
| 2,186,327 | 1/1940 | Crosser | D11/118 X |
| 2,279,182 | 4/1942 | Snyder | 362/123 X |
| 3,503,832 | 3/1970 | Umminger, Jr. . | |
| 4,186,503 | 2/1980 | Fontana | D11/118 X |

*Primary Examiner*—Peter A. Nelson
*Attorney, Agent, or Firm*—R. P. Miller

[57] ABSTRACT

This invention relates to an illuminated ornamental structure that is easily assembled and disassembled and, more particularly, to an assemblage of light transmitting components that may be packaged as a kit and subsequently erected to provide a simulated illuminated Christmas tree.

8 Claims, 7 Drawing Figures

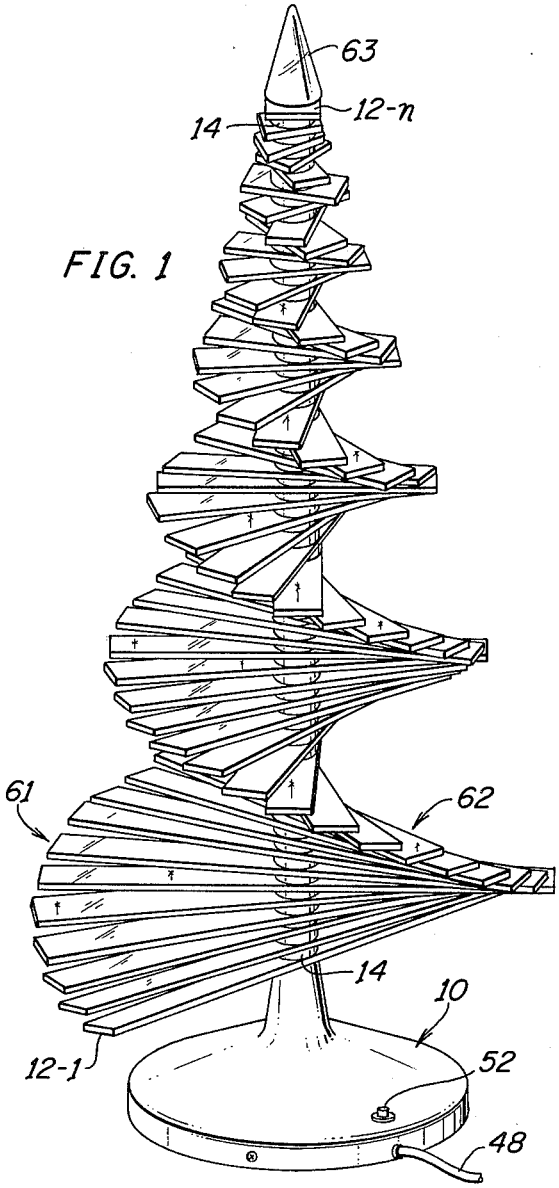
FIG. 1
FIG. 5
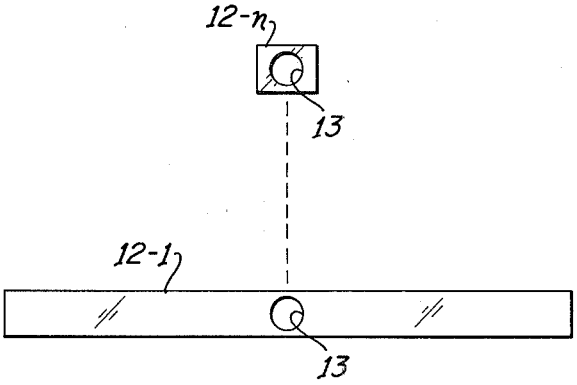
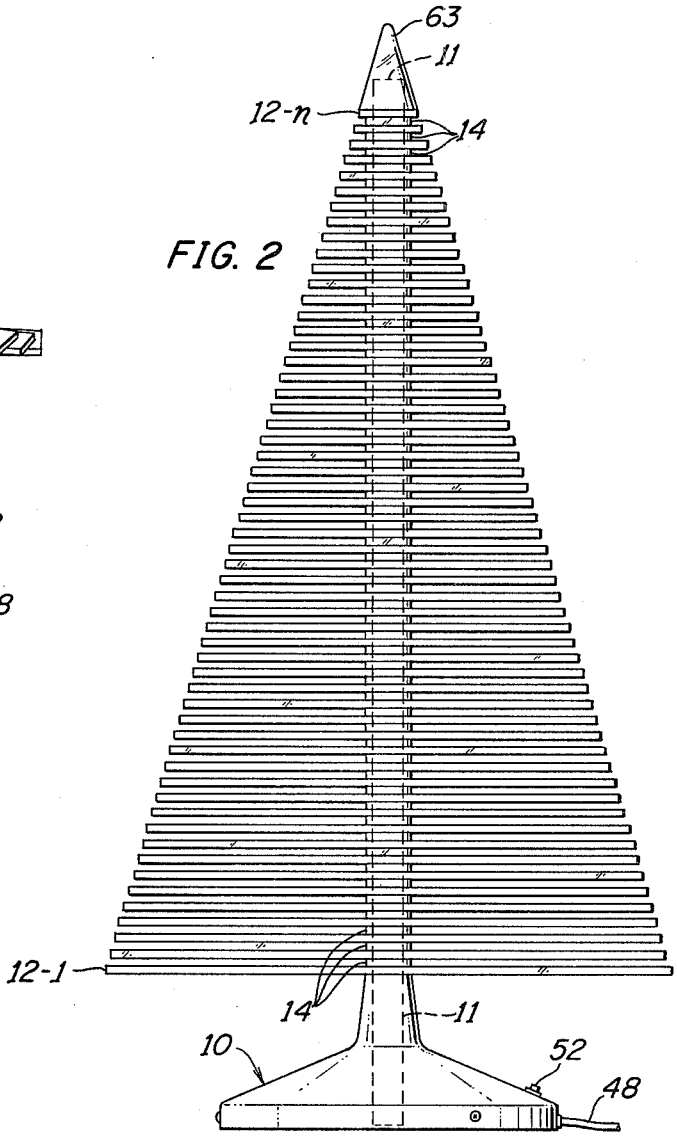
FIG. 2

FIG. 3
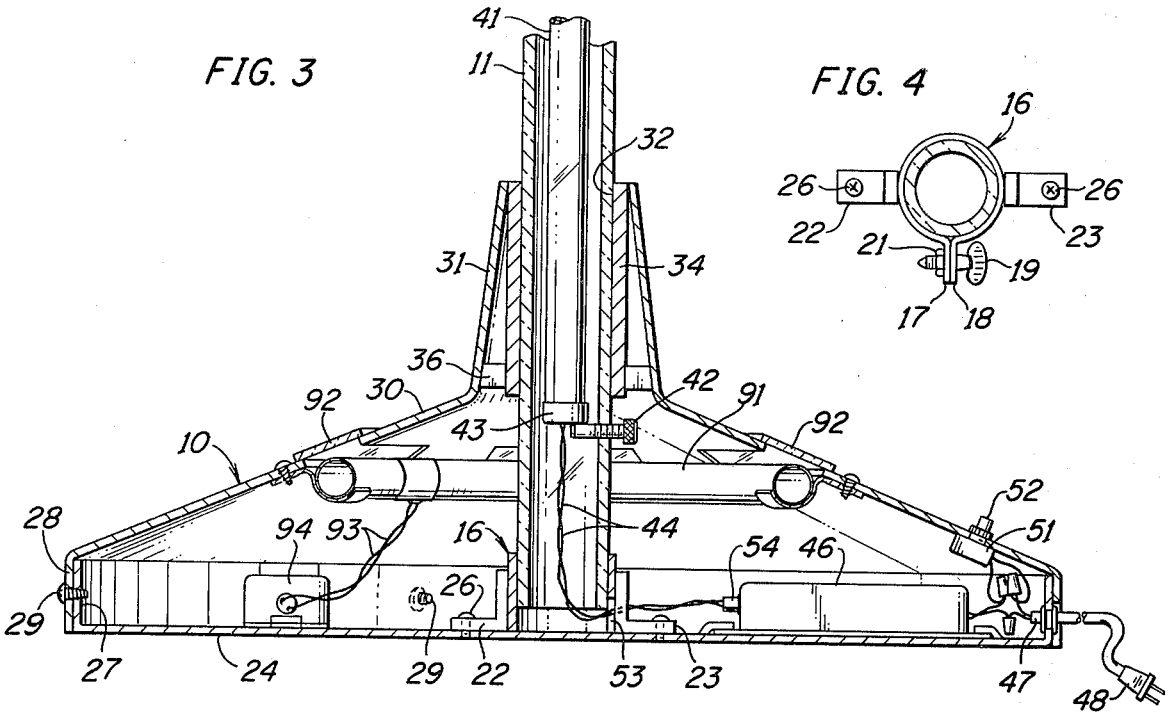
FIG. 4
FIG. 6
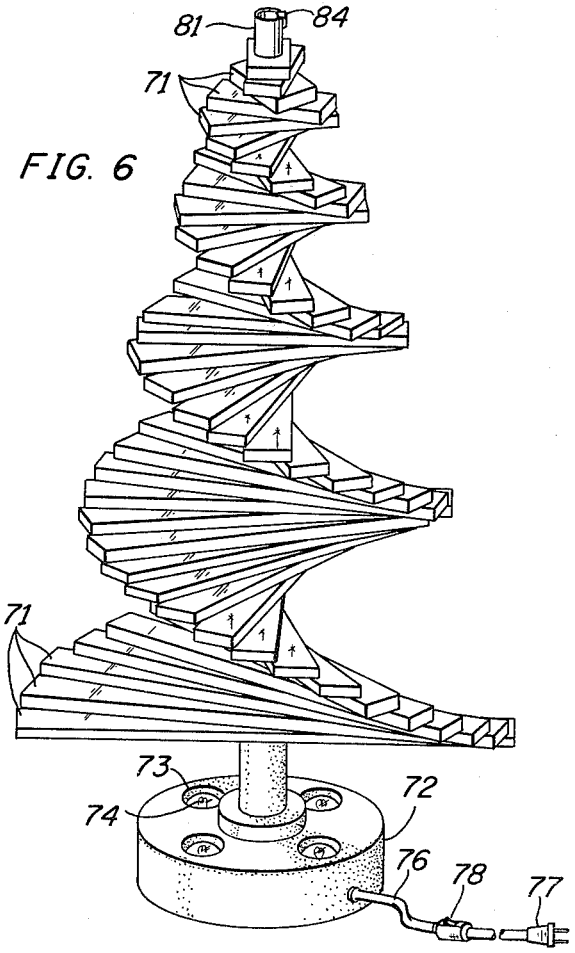
FIG. 7
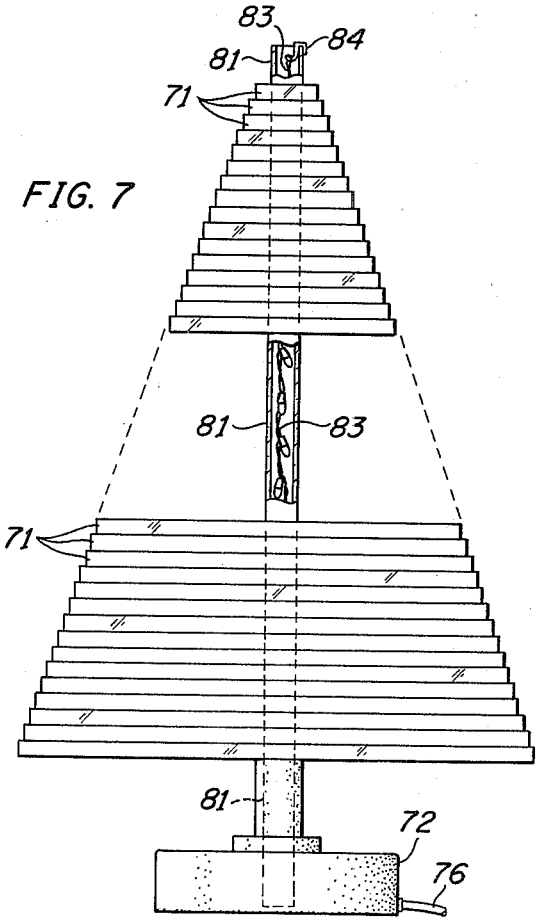

ILLUMINATED ORNAMENTAL STRUCTURE OF INTERPOSED TRANSMISSIVE SLATS AND COLLARS

BACKGROUND OF THE INVENTION

Heretofore numerous types of kits have been devised that may be assembled to simulate Christmas trees. Most of these tree kits include a base, a center post and branches which may be inserted in holes formed in the center post. Other artificial Christmas tree constructions contemplate pivotally mounting conical arrays of the branches on a center post so that the branches may be collapsed around the post for shipment or storage. When assembled, these prior art tree structures are generally illuminated by strings of decorative lights that are clipped onto the branches. In other constructions, an arrangement of flood lights is positioned about the tree to illuminate the branches and the ornamentation thereon.

In U.S. Design Pat. No. 250,519 issued Dec. 12, 1978, there is shown an illuminated Christmas tree constructed by supporting a spiral band about a center post. The band extends as a conical helix and strings of lights are supported along the edges of the band. The helical band is secured by struts projecting from a center post to provide a cone shape to the assembled tree.

Another artificial tree construction is shown in U.S. Design Pat. No. 130,937 issued Dec. 30, 1941, wherein a circular base supports a center member from which radiates rod-like elements. The rod-like elements are successively shorter in length from the bottom to the top of the tree, and are displaced from each other so that the tips define a conical helix simulating the outline of a tree.

In U.S. Pat. Nos. 2,041,481 issued May 19, 1936 to J. N. Otar and 3,503,832 issued Mar. 31, 1970 to F. W. Umminger, Jr., there are shown ornamental structures comprising a number of flat members of various shapes, each of which is provided with an aperture to receive a common post which is supported on a flat base. The flat members are displaced relative to each other in pivotally overlaying relation to provide a variety of geometric designs. In one embodiment of the Otar patent there is shown a lamp base which is made up of flat members of increasing dimension from the bottom to the top of the lamp base. These members are displaced from each other to provide an inverted pyramidal effect.

SUMMARY OF THE INVENTION

This invention contemplates, among other things, an ornamental structure constructed of light transmitting elements that may be quickly assembled to depict an illuminated Christmas tree or other light radiating ornamental structure.

More particularly, a stable base is provided to support a center hollow post constructed of light transmitting material. A set of slat-like members each of successively shorter length are formed with center apertures to permit mounting on the post. These slat-like members are also constructed of light transmitting material, and when mounted on the post may be moved or displaced relative to each other to expose portions of the upper and lower sides of each slat-like member. The members are of sufficient dimension and strength so as to be self-supporting. The slat-like members may be displaced about the center post so that the opposite end surfaces of the members define a pair of conical helices. Illumination means actuated by suitable controls mounted in the base are placed in the center post to not only illuminate the post, but also to radiate light to illuminate the slat-like members. Additional lighting means may be mounted in the base to project light on and through the light transmitting slat-like members to further enhance the illumination and glow of the assembled structure.

A further feature of the invention contemplates mounting spacer collars between the slat-like members. These collars are also constructed of light transmitting material and further enhance the structural appearance of the Christmas tree. In addition, the use of the light transmitting collars reduces the number of slat-like members needed to provide a tree-like appearance to the assemblage. It is further contemplated that the visual elements of the tree may be constructed of either transparent or translucent material that emit a glow when light is impinged on or through the material.

DESCRIPTION OF THE DRAWING

Other features and advantages of the invention will be apparent upon consideration of the following detailed description when considered in conjunction with the drawing, wherein:

FIG. 1 is a perspective view of an illuminated ornamental tree constructed in accordance with the principles of the present invention;

FIG. 2 is a front elevational view of the tree structure shown in FIG. 1 with slat-like elements simulating branches arrayed in a vertical plane-to illustrate the assembled tree prior to arraying the slat-like elements to simulate the tree shown in FIG. 1;

FIG. 3 is a cross-sectional view of a base for supporting the ornamental tree shown in FIGS. 1 and 2, and particularly illustrating the details of construction and arrangement of electrical components used to illuminate the tree;

FIG. 4 is a top view of a base clamp for holding the lower end of a center post on which the slat-like branch members are mounted;

FIG. 5 is a top view of two of the slat-like members that are to be assembled on the post;

FIG. 6 is a perspective view of an alternative embodiment of the invention showing slat-like members that may be constructed of translucent material and mounted on a center post to receive light projecting from a base supporting the center post, and FIG. 7 is a front elevational view of the tree shown in FIG. 6 with the slat-like members positioned in planar array and cut away to show a string of lights for illuminating the center post.

DETAILED DESCRIPTION

Referring to FIGS. 1 and 2, there is shown a base 10 from which extends a center post 11 constructed of a hollow cylinder of transparent plastic material. Positioned on and along the post are a number of slat-like members 12-1 to 12-n which are further illustrated in FIG. 5. Each member is provided with a center aperture 13 and is dimensioned so as to be self-supporting when mounted on the center post 11. These slat-like members may be constructed from any one of a large number of light transmitting plastic materials, such as the material sold under the trademark Plexiglass®. Separating the slat-like members 12 on the post 11 are a number of collars 14 that are also constructed of light transmitting materials. Inasmuch as each slat-like branch is supported on a collar it may be appreciated that the branches or slat-like members 12 must be thick enough to be self-supporting without any droop.

As shown in FIG. 3, the lower end of the center post 11 extends into the base 10 and is held from shifting by a circular split clamp 16 (see FIG. 4) having ears 17 and 18 held together in clamping position by a thumb screw 19 and a nut 21. The clamp is formed with, or has attached thereto, a pair of laterally extending L-shaped braces 22 and 23 which are secured to a bottom wall 24 by screws 26. The bottom wall 24 is formed with an upwardly extending peripheral rim 27 that is fitted within a downwardly extending circumferential lip 28 forming part of the main portion of the base 10. The lip 28 is selectively secured to the rim 27 by a number of machine screws 29 screwed through suitable apertures formed in the lip and rim.

The base 10 may be constructed of opaque plastic and is formed to provide a low pitch conical section 30 that joins a high pitch conical section 31. Section 31 is provided with an aperture 32 to receive the post 11. The support provided to the post 11 by the wall of the aperture 32 and the clamp 16 may be sufficient to hold the post 11 in an upright position. However, in order to provide added support, a sleeve 34 may be mounted within the neck section 31 and secured in place by a number of struts 36. The sleeve 34-strut 36 arrangement may be permanently mounted within the neck-like conical section 31 or may be press-fitted in place.

The illumination of the tree in this instance is provided by a fluorescent tube 41 mounted within the the transparent hollow post 11. The tube is held spaced from the bottom of the post by a thumb screw or stop 42 extending through the wall of the tube 11. An igniter 43 mounted on the lower end of the tube 41 is connected by wires 44 to a ballast 46 which, in turn, is connected to an electrical cord 47 running to a household outlet plug 48. The cord 47 runs through a pushbutton switch 51 having a plunger 52 extending beyond housing section 30. The switch 51 is of commercial manufacture and is adapted to ignite the fluorescent tube 41 upon a first depression and to shut the tube off upon a second depression.

The structural elements thus far described are components that may be readily packaged in a convenient box and sold as a kit to be assembled by the purchaser. The structure is assembled by inserting the post 11 in the opening 32 and seating the end of the post within the clip 16. The fluorescent tube 41 may be pre-mounted in the post 11 with the wires 44 extending from the bottom of the tube so as to be passed through a slot 53 formed in the clip 16. The end of the wire 44 is provided with a plug 54 which is inserted in a socket associated with the ballast 46. The collar spacers 14 are alternately assembled with the slats 12 on the post 11. The assembly operation is such that the longest slat is first placed on the post and then each succeeding shorter slat is mounted on the post. When assembled, the slats and collars will appear as shown in FIG. 2 so that the overall structure appears as a triangle simulating the outline of a pine tree. The bottom 24 of the base 10 is constructed to be slightly flexible to conform to any uneveness of a floor. By mounting the electrical controls in the base, the stability of the assembled structure is augmented.

The individual slats may now be rotated relative to each underlying slat to assume a position displaced a few degrees of the underlying slat. The net effect of this displacement is that the ends of the slats are arrayed as to conical helices 61 and 62. A conical or other decorative shaped cap 63 may be placed on the end of the post 11.

When the plug 48 is inserted in the electrical wall socket and the pushbutton switch 51 is operated, the fluorescent tube 11 is illuminated. The light radiates through the walls of the apertures 13 and passes along the length of the slats so that the entire length of each slat is illuminated and presents a pleasing low intensity glow. The light is emitted from the ends of the slats and it appears intensified so as to outline the two conical helices 61 and 62. Inasmuch as the center post 11 and the collars 14 are constructed of light transmitting material, these elements also glow and add to the overall illusion of a completely light emitting structure. This impression may be obtained whether the structural elements are constructed of transparent material or translucent material. When the structural elements are constructed of transparent material, all or selected elements may be frosted to create added visual impressions. If the illuminating tube 41 is of the common fluorescent type, the overall structure appears as white in color. In this instance the surface of the base 10 may also be colored white to harmonize with the illuminated elements. It should be understood, however, that other light emitting tubes, such as a neon tube, may be substituted for the fluorescent tube 41, in which instance the structure will assume a redish hue. Further, it is contemplated that, if desired, the structured tree may be constructed of slats without the use of intervening collars.

An alternative embodiment of the invention is shown in FIGS. 6 and 7 wherein slat-like members 71 similar to members 12 are constructed of a foam plastic material that is translucent to impressed light. In this instance, a base 72 may be constructed in a cylindrical shape and provided with a number of recesses 73 for receiving light bulbs 74 which are illuminated by electrical circuitry contained in the base 72 running to a cord 76 attached to a plug 77. A switch 78 may be included in the cord 76 or the switch may be mounted on the housing 72. The light bulbs 74 are preferably a spotlight variety so as to project light beams upwardly onto the overlaying slat member 71.

The slat members 71 are mounted one on top of each other on a post 81 which again is constructed of light transmitting material, such as used to construct a post 11 of the embodiment shown in FIG. 1. Instead of a tube illuminating the inside of the post, a string of small electric lamps 83 may be utilized, e.g., Italian lights, or regular Christmas tree lights. The upper end of the string is provided with a clip 84 that rests on the top of the post 81.

When the switch 78 is actuated, the lamps 83 are illuminated to radiate light into the translucent slats 71. Light projecting from the lamps 74 also pass through the translucent slats to enhance the illumination of the lower portion of the structure. The net effect is that each one of the translucent members appears to glow. In certain instances it may be desired to eliminate the spotlights to reduce the cost of the overall structure. It has been found that the use of the string of lights 83 is sufficient to illuminate the slats 71.

When the slats 71 are displaced from the planar position shown in FIG. 7 to the conical helix position shown in FIG. 6, portions of each succeeding slat overlies a portion of the underlying slat so that the overlying slat receives support, and thus, other than the first slat, need not be completely self-supporting.

The use of the foam material for the slats 71 enables a user to pin other ornamentations at the ends of the slats and also along the exposed lengths of the slats.

A further modified version of the invention may include a circular fluorescent tube 91 (see FIG. 3). In this instance, a section 92 of the housing 10 may be constructed of transparent material. The circular fluorescent tube 91 is connected by wires 93 to a ballast 94 connected, in turn, to the energizing circuit running through the switch 51. The use of the circular fluorescent tube 91 causes an additional circular beam of light to be impinged on the lower side of the conical arrayed slats 12. This added light will enhance the glow of the lower portion of the Christmas tree structure.

I claim:

1. An ornamental illuminated artificial Christmas tree which comprises:

a conical hollow cylindrical post constructed of light transmitting material;

a plurality of slat-like members, each having a hole therethrough, each of the members being constructed of light transmitting material and mounted with the post extending through the holes, each of said members being self-supporting;

a plurality of circular collars mounted on said post, each of said collars being constructed of light transmitting material and each mounted to encircle the circumference of said post in positions interposed between said slat-like members for supporting said slat-like members in non-contacting relation; and means mounted within said post for illuminating the entire length of said post and transmitting light from the post to the slat-like member and collars assembled on the post.

2. An ornamental structure as defined in claim 1, wherein the light transmitting, slat-like members are constructed of transparent material.

3. An ornamental structure as defined in claim 1, wherein the light transmitting members are constructed of translucent material.

4. An ornamental structure as defined in claim 1, wherein the illuminating means include a fluorescent tube mounted within and extending along the post of sufficient distance to radiate light into each of the slat-like members.

5. An ornamental structure as defined in claim 1, wherein the illuminating means include a string of discrete light emitting devices spaced apart distances sufficient to illuminate each of the slat-like members mounted on the post.

6. An ornamental structure as defined in claim 1, which comprises:

a base for supporting said post in a vertical position; and a plurality of light emitting means mounted in the base for projecting light onto the light transmitting slat-like members mounted on the post.

7. An ornamental structure as defined in claim 1, wherein the slat-like members are of different lengths and mountable on said post and progressively displaceable about said post to position the opposite ends of the member to define a pair of conical helices.

8. A kit for assembling an illuminated Christmas-type tree, which comprises:

a plurality of light transmitting slats, each of which is self-supporting and of a different length, and each slat having an aperture passing through center portions of the flat sides thereof;

a cylindrical pole having a hollow center for receiving a means of illumination;

said pole having an outer diameter that closely approximates the inner diameter of the aperture in the slats, said pole being constructed of light transmitting material;

means mountable within said hollow pole for illuminating said pole and said collars;

a plurality of light transmitting circular collars for mounting on said pole in positions between said light transmitting slats each of said collars having an internal diameter that permits mounting of said collars on said pole to closely encircle the circumference of said pole;

a base housing having a bottom wall for resting on a floor and an opening in a top portion thereof adapted to receive and support the pole in a vertical position; and a clip attached to the inner side of said bottom wall adapted to receive and hold the lower end of said pole when said pole is passed through said hole in the housing.

* * * * *